US010028556B2

(12) United States Patent
Monk et al.

(10) Patent No.: US 10,028,556 B2
(45) Date of Patent: Jul. 24, 2018

(54) MULTIPURPOSE WALKING DEVICE

(71) Applicant: Jeremy Laurence Monk, Prague (CZ)

(72) Inventors: Jeremy Laurence Monk, Prague (CZ); Cornell John Monk, Essex (GB)

(73) Assignee: Jeremy Laurence Monk, Prague (CZ)

( * ) Notice: Subject to any disclaimer, the term of this patent is extended or adjusted under 35 U.S.C. 154(b) by 0 days.

(21) Appl. No.: 15/316,126

(22) PCT Filed: May 29, 2015

(86) PCT No.: PCT/GB2015/051576

§ 371 (c)(1),
(2) Date: Dec. 2, 2016

(87) PCT Pub. No.: WO2015/185896

PCT Pub. Date: Dec. 10, 2015

(65) Prior Publication Data

US 2017/0143082 A1 May 25, 2017

(30) Foreign Application Priority Data

Jun. 4, 2014 (GB) ..... 1409912.1

(51) Int. Cl.

| | |
|---|---|
| ***A45B 3/00*** | (2006.01) |
| ***A45B 9/02*** | (2006.01) |
| ***A45B 25/00*** | (2006.01) |
| ***A47G 25/82*** | (2006.01) |

(52) U.S. Cl.

CPC ..... *A45B 3/00* (2013.01); *A45B 9/02* (2013.01); *A45B 25/00* (2013.01); *A47G 25/82* (2013.01)

(58) Field of Classification Search

CPC .. A45B 3/00; A45B 25/00; A45B 9/02; A47G 25/82

See application file for complete search history.

(56) References Cited

U.S. PATENT DOCUMENTS

| | | | | |
|---|---|---|---|---|
| 3,591,226 A | | 7/1971 | Elmore | |
| 4,709,839 A | * | 12/1987 | Tucker | A47G 25/82 223/119 |
| 4,966,316 A | * | 10/1990 | George | A47G 25/82 135/66 |
| 6,951,224 B2 | * | 10/2005 | Garrett | A45B 7/005 135/66 |

(Continued)

FOREIGN PATENT DOCUMENTS

| | | |
|---|---|---|
| DE | 202009001117 U1 | 4/2009 |
| JP | H0392122 U | 9/1991 |

*Primary Examiner* — Noah Chandler Hawk

(74) *Attorney, Agent, or Firm* — Daniel E. Stout; Stout, Uxa & Buyan, LLP

(57) ABSTRACT

A multipurpose walking device is disclosed comprising a shaft (4) and a handle (6), the handle (6) being moveable in relation to the shaft between a first securable position and a second securable position, in which movement of the handle (6) between the first securable position and the second securable position causes a shoehorn (20) to move from a first retained position to a second deployed position. The incorporation of the shoehorn (20) into the multipurpose walking device allows a user to assist themselves when putting on footwear, while substantially reducing bending, and then to walk away. Such a restoration of mobility to a user is highly advantageous.

5 Claims, 7 Drawing Sheets

(56) References Cited

U.S. PATENT DOCUMENTS

| | | | | |
|---|---|---|---|---|
| 8,381,748 | B2 * | 2/2013 | Martin | A45L 33/00 135/66 |
| 9,326,630 | B1 * | 5/2016 | Showalter | A47G 25/82 |
| 2004/0255995 | A1 | 12/2004 | Garrett | |
| 2015/0196102 | A1 * | 7/2015 | Moreau | A45B 9/00 135/66 |

* cited by examiner

MULTIPURPOSE WALKING DEVICE

This invention relates to a multipurpose walking device having particular, but not exclusive, utility for the infirm. It is of particular benefit that the multipurpose walking device incorporates a shoehorn.

Many people are afflicted with back, hip or other movement restricting conditions that range from causing simple discomfort to chronic pain to those afflicted. Regardless of their position on this spectrum, simple tasks such as putting on footwear become more difficult for those afflicted as a result. In extreme cases, a person may be unable to lead a normal life and must rely upon others to perform nearly every task that requires even the slightest amount of bending or stooping movement. It is an aim of the present invention to provide at least a partial solution to this problem.

It will be understood that the present invention may find other applications, for example use among those recovering from surgery where such stooping or bending may impair recovery or the discomfort of doing so may discourage the undertaking of physiotherapy thereby impeding recovery.

According to the present invention, a multipurpose walking device comprises a shaft and a handle, the handle being moveable in relation to the shaft between a first securable position and a second securable position, in which movement of the handle between the first securable position and the second securable position causes a shoehorn to move from a first retained position to a second deployed position.

It will be understood that the incorporation of the shoehorn into the multipurpose walking device allows a user to assist themselves when putting on footwear, while substantially reducing bending, and then to walk away. Such a restoration of mobility to a user is highly advantageous.

Preferably when the handle is secured in the second securable position, the shoehorn is secured in the deployed position.

Preferably, the handle is rotated with respect to the shaft. More preferably the handle is rotated toward the shaft.

Preferably the handle is secured in the first securable position by a displaceable member.

Preferably the handle is secured in the second securable position by a displaceable member. More preferably, the handle is secured in each of the first securable position and the second securable position by the same displaceable member.

Preferably, the multipurpose walking device is a walking stick. Alternatively, the multipurpose walking device is an umbrella.

Preferably, the shoehorn is connected to the handle by a connecting rod.

The invention will now be described, by way of example only, in relation to the attached Figures, in which FIG. 1 shows a schematic side view in part section of a multipurpose walking device in accordance with the present invention with elements in a first position;

Figure 1:
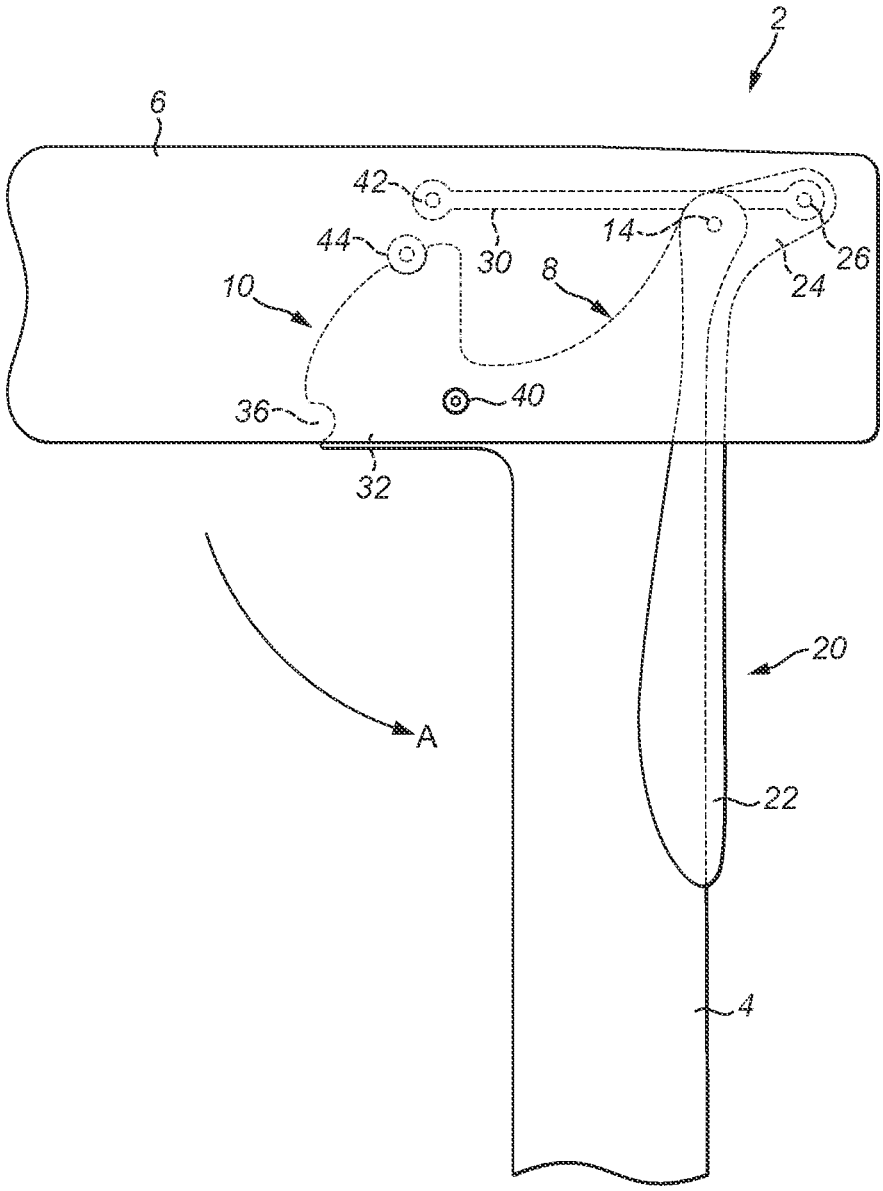
Figure 2:
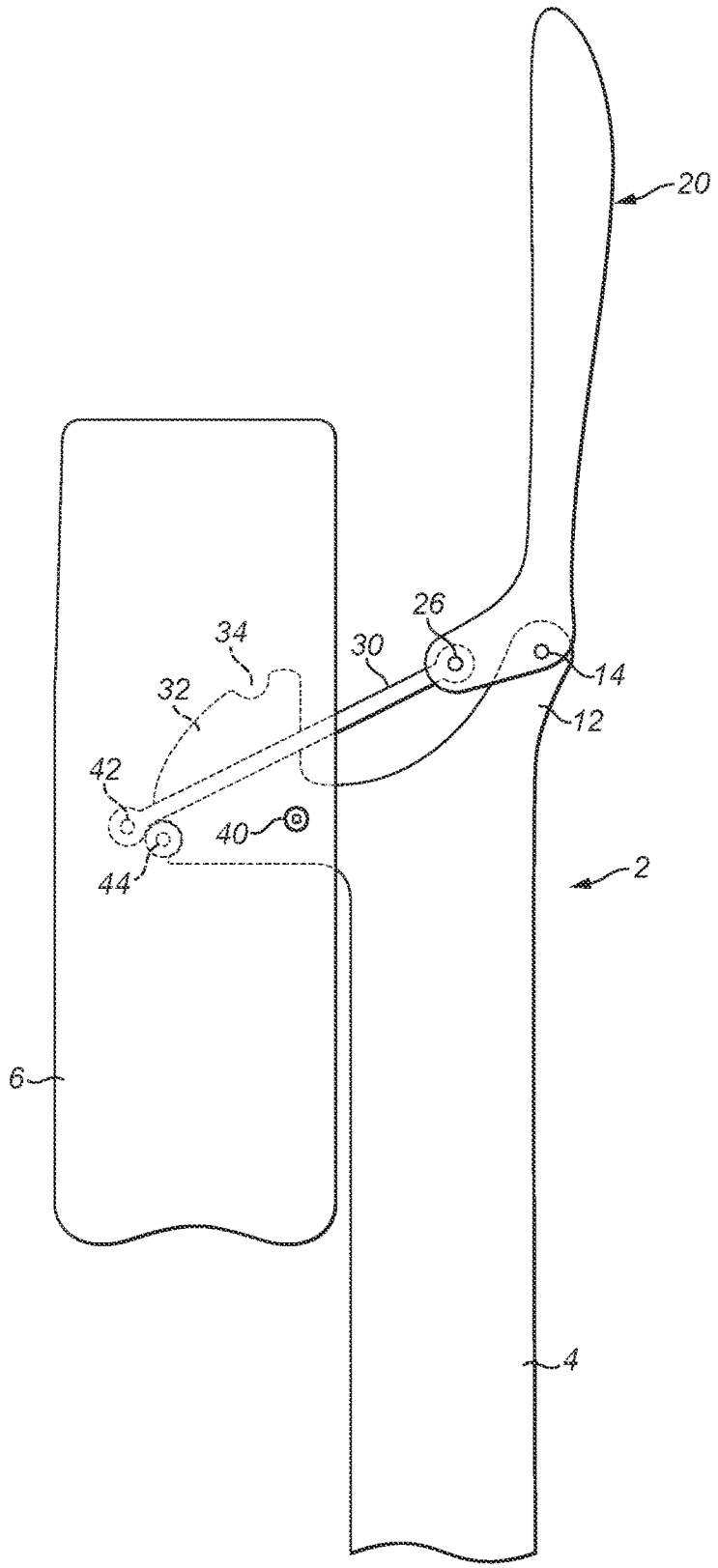
FIG. 2 shows a schematic side view in part section of the multipurpose walking device of FIG. 1 with the elements in a second position.

Referring to FIGS. 1 and 2, there can be seen one end of a multipurpose walking device 2 in accordance with the present invention. The multipurpose walking device may conveniently take the form of a walking stick or an umbrella.

The multipurpose walking device can be seen to include an elongate shaft 4 having a handle 6 at a first end. The handle 6 is mounted for rotation with respect to the shaft 4.

The first end of the elongate shaft 4 is provided with a mounting structure. The mounting structure may be formed integrally with the elongate shaft 4 or may itself be secured to the elongate shaft 4.

In the illustrated embodiment, the mounting structure comprises a accessory support 8 and a handle support 10.

In practice the accessory support 8 is generally U-shaped with the front limb only shown in the figures (the rear limb being hidden behind the front). A pivot pin 14 extends between the front and rear limbs of the accessory support 8.

A shoehorn 20 is mounted to the accessory support 8. The shoehorn 20 is generally L-shaped having a longer limb 22 and a shorter limb 24. The longer limb 22 is shaped at its free end to fit an item of footwear, such as a shoe, slipper or training shoe and enable a user to slide a foot into the item of footwear. The shorter limb 24 extends around the accessory support 8. A free end of the shorter limb 24 is connected to a pin 26 in turn connected to a first end of a connecting rod 30, while another end of the shorter limb 24 is provided with parallel openings. In practice the pivot pin 14 extends through these openings and corresponding openings (not shown) in the accessory support 8 to mount the shoehorn 20 to the accessory support 8.

Figure 3:
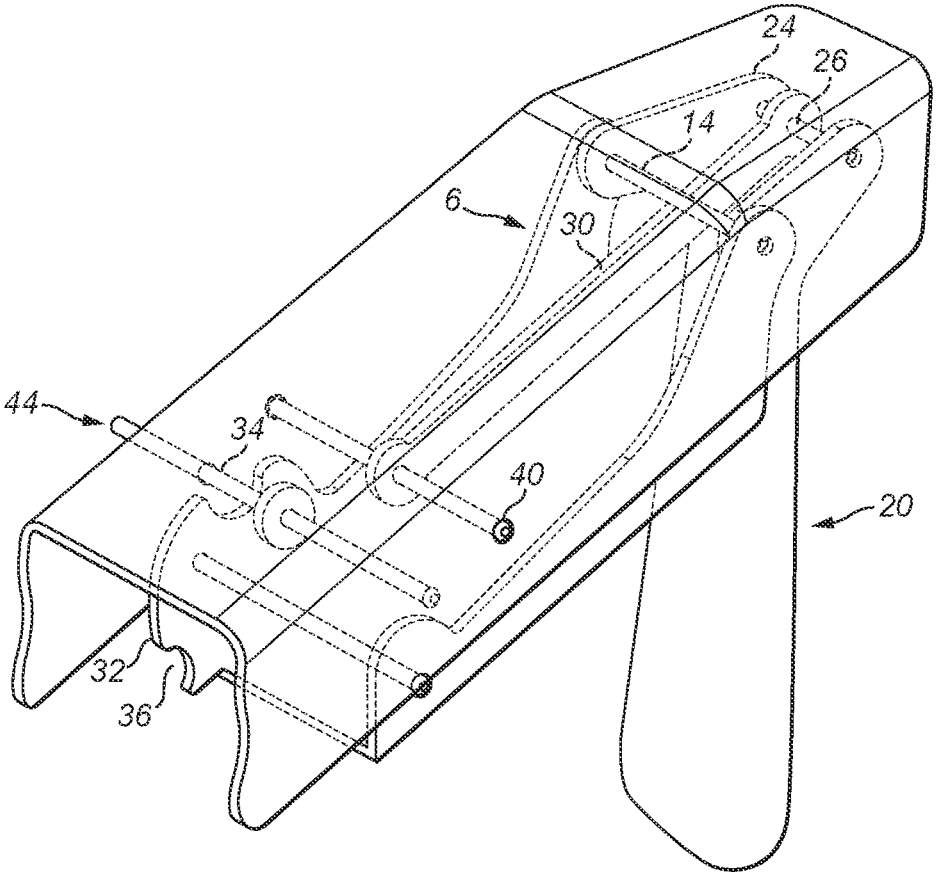
FIG. 3 shows a schematic perspective part cut-away view of a second embodiment handle and shoehorn for use with a multipurpose walking device in accordance with the present invention with elements in a first position.

The handle support 10 conveniently comprises two protrusions providing cammed surfaces (the rear protrusion being hidden behind the front in the Figures). The cammed surfaces are aligned with one another. Each of the cammed surfaces is provided with aligned first and second recesses 34,36. In an alternative construction, (for example, as shown in FIG. 3) the cammed surface is provided to one side only and the first and second recesses 34,36 only provided on the cammed surface present. The handle 6 is mounted to the handle support 10.

The handle 6 conveniently comprises a hollow member including a longitudinal recess or channel. In FIG. 1, it can be seen that the handle 6 covers the handle support 10, the accessory support 8 and (when in this position) an upper end of the shoehorn 20 such that the handle support 10, the accessory support 8 and the upper end of the shoehorn 20 are located within the channel of the handle 6. A pivot pin 40 extends through the handle 6 and the handle support 10 to allow the handle 6 to pivot. The pivot pin 40 is located approximately half way along the handle 6 and in a lower region thereof. A second pin 42 extends through the handle 6 approximately half way along the handle and in an upper region thereof. The second pin 42 is connected to a second end of the connecting rod 30.

The handle 6 is further provided to at least one side with an opening for a locating pin 44. The locating pin 44 may operate in any suitable manner and may for example be spring biased to a seated position.

When the handle 6 is in a first securable position, the locating pin 44 is operable releasably to seat in the first aligned recesses 34 in the handle support 10.

In the secured position shown in FIG. 1, the connecting rod 30 acts to keep the shoehorn 20 in position with respect to the elongate shaft 4 of the multipurpose walking device 2.

To deploy the shoehorn 20, the locating pin 44 is first released from the first aligned recesses 34. The handle 6 may then be rotated with respect to the elongate shaft 4 (see arrow A in FIG. 1). The second pin 42 is drawn over the camming surfaces such that the shoehorn 20 is pivoted about the accessory support 8 until the shoehorn 20 is in the deployed position shown in FIG. 2. The locating pin 44 is then adjusted to seat in the second aligned recesses 36 to secure the handle 6 (and so the shoehorn 20) in position.

Once the user has put their footwear on, the shoehorn 20 is returned to the stored position and the handle 6 to the first position by reversing the above steps. In other words the locating pin 44 is unseated from the second recesses 36 allowing the handle 8 to pivot and the shoehorn 20 to be driven around its pivot pin 14 by the connecting rod 30 until the locating pin 44 may once again be seated in the first aligned recesses 34.

It can be seen that the construction illustrated in FIG. 3 operates in an identical manner to that of FIGS. 1 and 2 (like reference numerals have been used for like parts).

Figure 4:
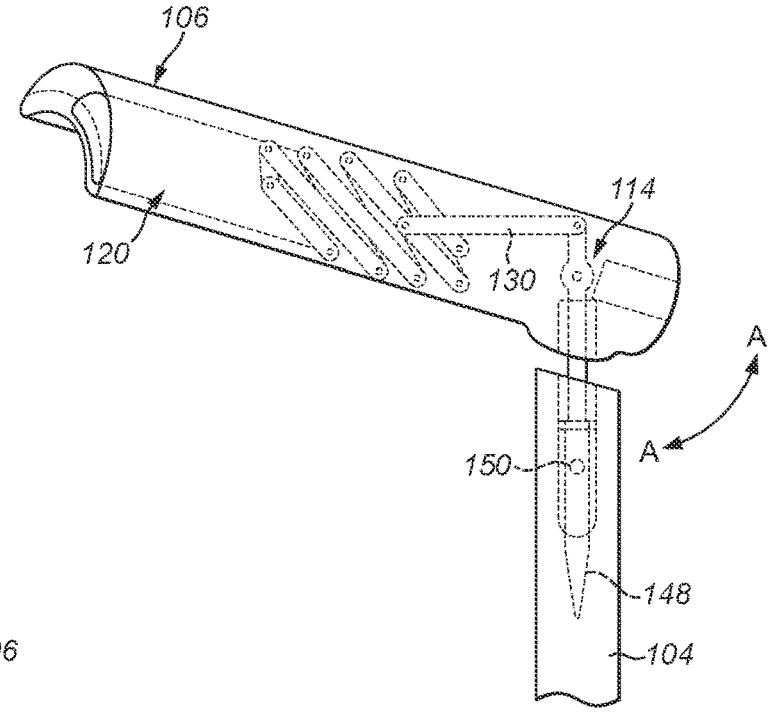
FIG. 4 shows a schematic side view in part section of a third embodiment of a multipurpose walking device in accordance with the present invention with elements in a first position.
Figure 5:
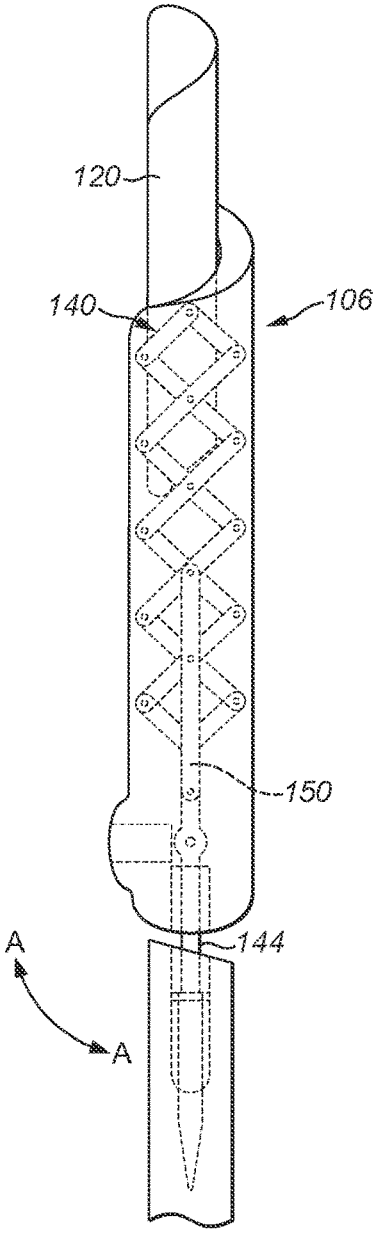
FIG. 5 shows a schematic side view in part section of the multipurpose walking device of FIG. 4 with the elements in a second position.
Figure 6:
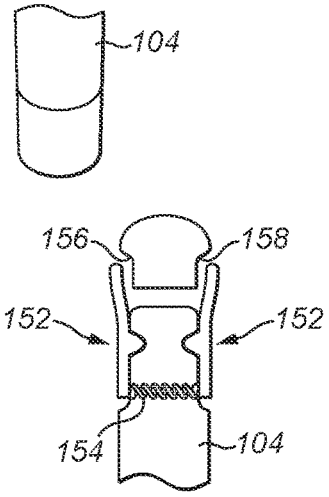
FIG. 6 shows a detail of the multipurpose walking device of FIG. 4.

A further embodiment of a multipurpose walking device in accordance with the present invention is shown in FIGS. 4 to 6. The device comprises a shaft 104 and a handle 106. A shoehorn 120 is located for deployment from within the handle 106. The handle 106 may be rotated between a first position (FIG. 4) in which the shoehorn 120 is retained within the handle 106 and a second position (FIG. 5) in which the shoehorn 120 is deployed (arrows A-A).

The handle 106 is formed at a first end with a first recess or channel 140. The shoehorn 120 operates from the first channel. The handle 106 is provided at a second end with an eye bolt or pin 144 housed therein. The eye bolt 144 is provided with an enlarged section along its length. A pivot pin 114 extending though the enlarged section connects the handle to the eyebolt 144.

A scissor mechanism 146 is located within the first channel 140 and secured toward a second end of the first channel. A connecting rod 130 is connected at a first end toward the first end of the scissor mechanism 146 and at a second end to a first end of the eye bolt 144. The connecting rod 130 is connected at each end to allow for pivoting movement.

The eye bolt 144 is connected by any suitable means at a second end to a fixed point within a channel 148 provided in a first end of the shaft 104. For example, a through pin 150 may extend through the shaft 104 and the second end of the eyebolt 144.

Any suitable releasable locking means may be used to secure releasably the shaft 104 and the handle 106 in position relative to one another. For example, oppositely located crocodile type clips 152 on the first end of the shaft 104 may be provided biased together, for example, by a spring 154 (FIG. 6) located within shallow grooves 156,158 provided toward the first end of the shaft 104 and an adjacent portion of the handle 106.

In FIG. 4, the handle 106 is shown in a first securable position with the scissor mechanism 146 contracted and the shoehorn 120 in a retained position. A user releases the locking means and rotates the handle 106 to a position in line with the shaft 104 as shown in FIG. 5 (arrows A-A). It can be seen that this movement causes the connecting rod 130 to pull on the scissor mechanism 146 thereby causing the scissor mechanism 146 to expand and the shoehorn 120 to move to a deployed position. The user secures the locking means in position to retain the shaft 104 and the handle 106 in position, and the shoehorn 120 in the deployed position. Once the shoehorn 120 has been used as desired, the user simply unlocks the locking means, returns the handle 106 to its first position relative to the shaft 104 (arrows A-A) and once again secures the releasable locking means to maintain the shaft 104 and the handle 106 in position.

Figure 7:
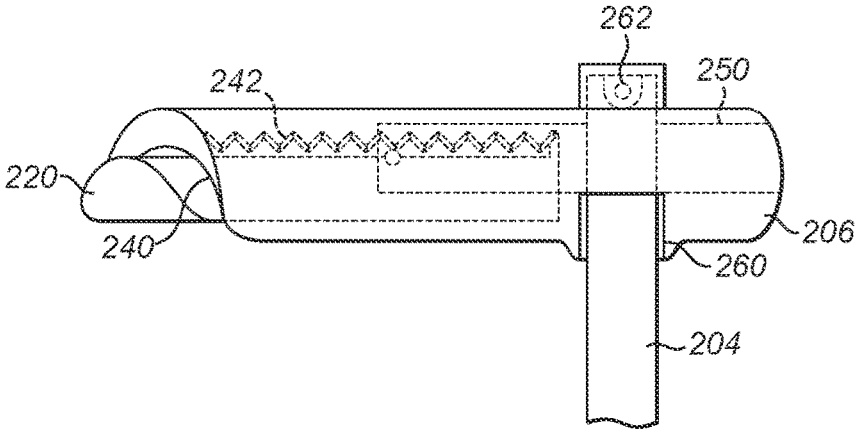
FIG. 7 shows a schematic side view in part section of a fourth embodiment of a multipurpose walking device in accordance with the present invention with elements in a first position.
Figure 8:
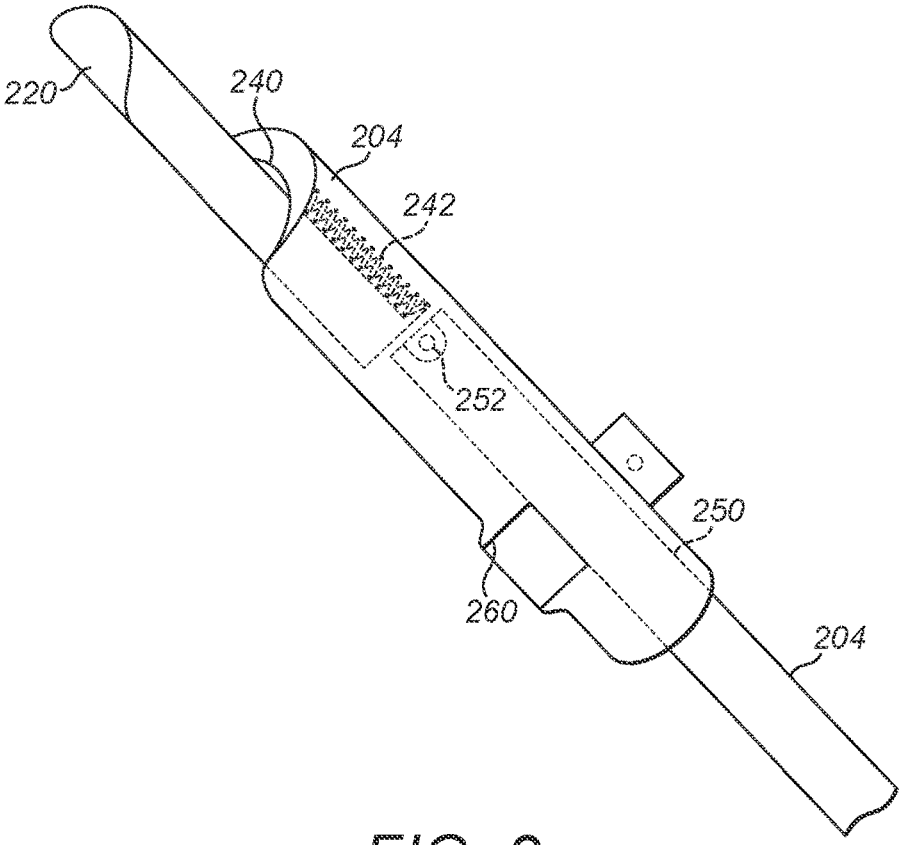
FIG. 8 shows a schematic side view in part section of the multipurpose walking device of FIG. 7 with the elements in a second position.

A further embodiment of the invention is shown in FIGS. 7 and 8. A handle 206 and a first end of a shaft 204 are shown in a first relative position. The handle 206 is provided with a first longitudinal channel 240 within which a shoehorn 220 is retained and a longitudinal blind bore 250 offset from the first channel 240. The first channel 240 further includes a groove within which a biasing means such as spring 242 is located. The biasing means is preferably connected at a first end to the handle 206 and at a second end to a second end of the shoehorn 220. The shoehorn 220 is biased to be retained within the first channel 240. The handle 206 includes a second blind bore 260 disposed orthogonally to the first blind bore 250. In alternative embodiments (not shown), the second blind bore may be disposed at a different angle to the first blind bore.

A first end of the handle 206 is releasably secured, that is locked, within the second bore by any suitable means, for example complementary bayonet means 262 provided at the first end of the shaft 204 and a blind end of the second blind bore 260.

To deploy the shoehorn 220, a user unlocks and removes the first end of the shaft 204 from the second blind bore 260. The user then inserts the first end of the shaft 204 into the first blind bore 250 against the action of the biasing means causing the shoehorn 220 to extend from the channel 240 and become deployed. Once the shoehorn 220 is in the deployed position, the user secures the first end of the shaft 204 to suitable securing means located at the blind end of the first blind bore 250, for example complementary bayonet means 252.

Once the shoehorn 220 has been used, the user may unlock the shaft 204 from the handle 206, remove the first end of the shaft 204 from the first blind bore 250 allowing the biasing means to return the shoehorn 220 from the deployed position to the retained position, insert the first end of the shaft 204 into the second blind bore 260 and resecure the first end of the shaft 204 to the handle 206.

Figure 9:
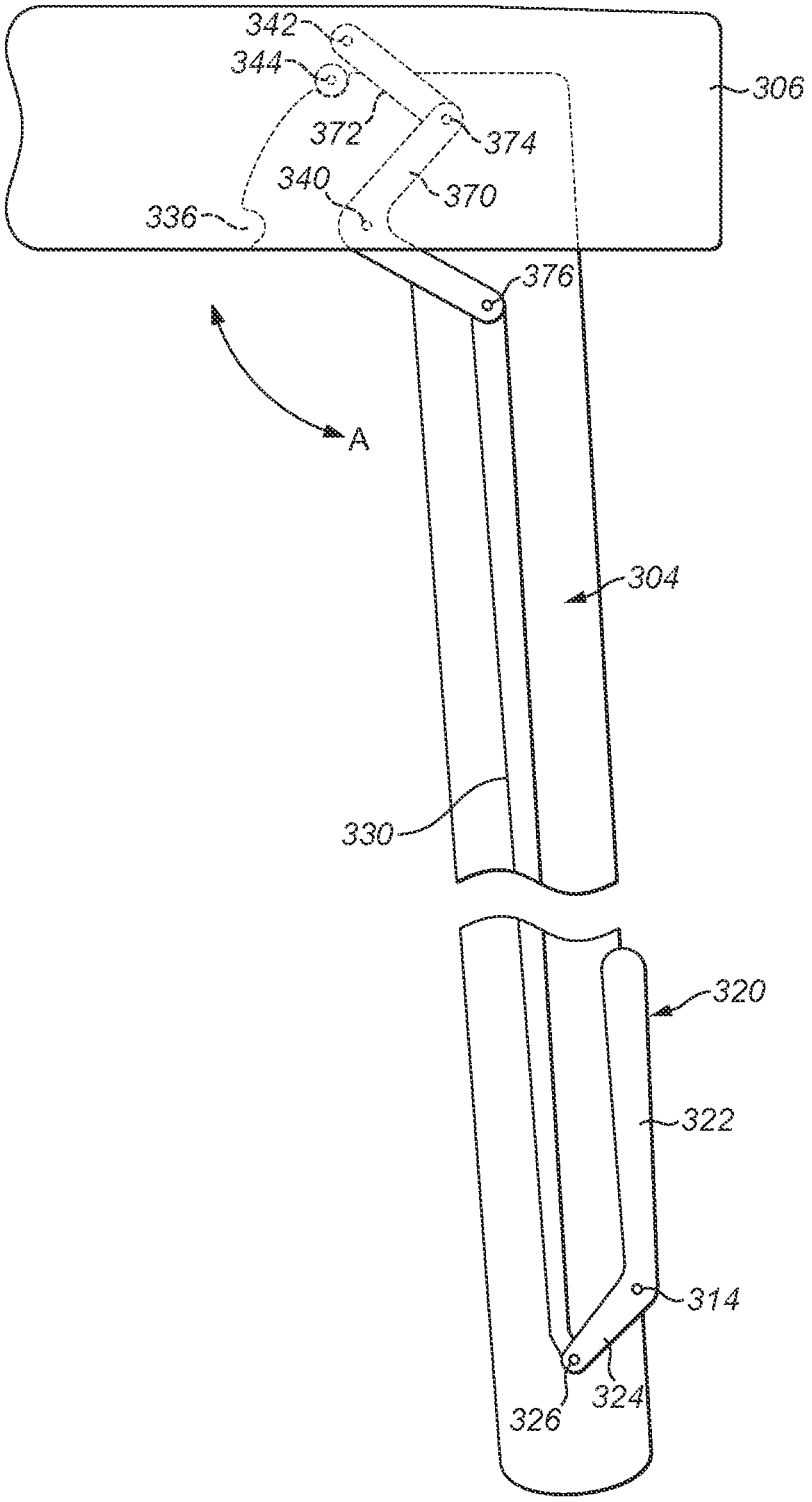
FIG. 9 shows a schematic side view in part section of a further multipurpose walking device in accordance with the present invention with elements in a first position.
Figure 10:
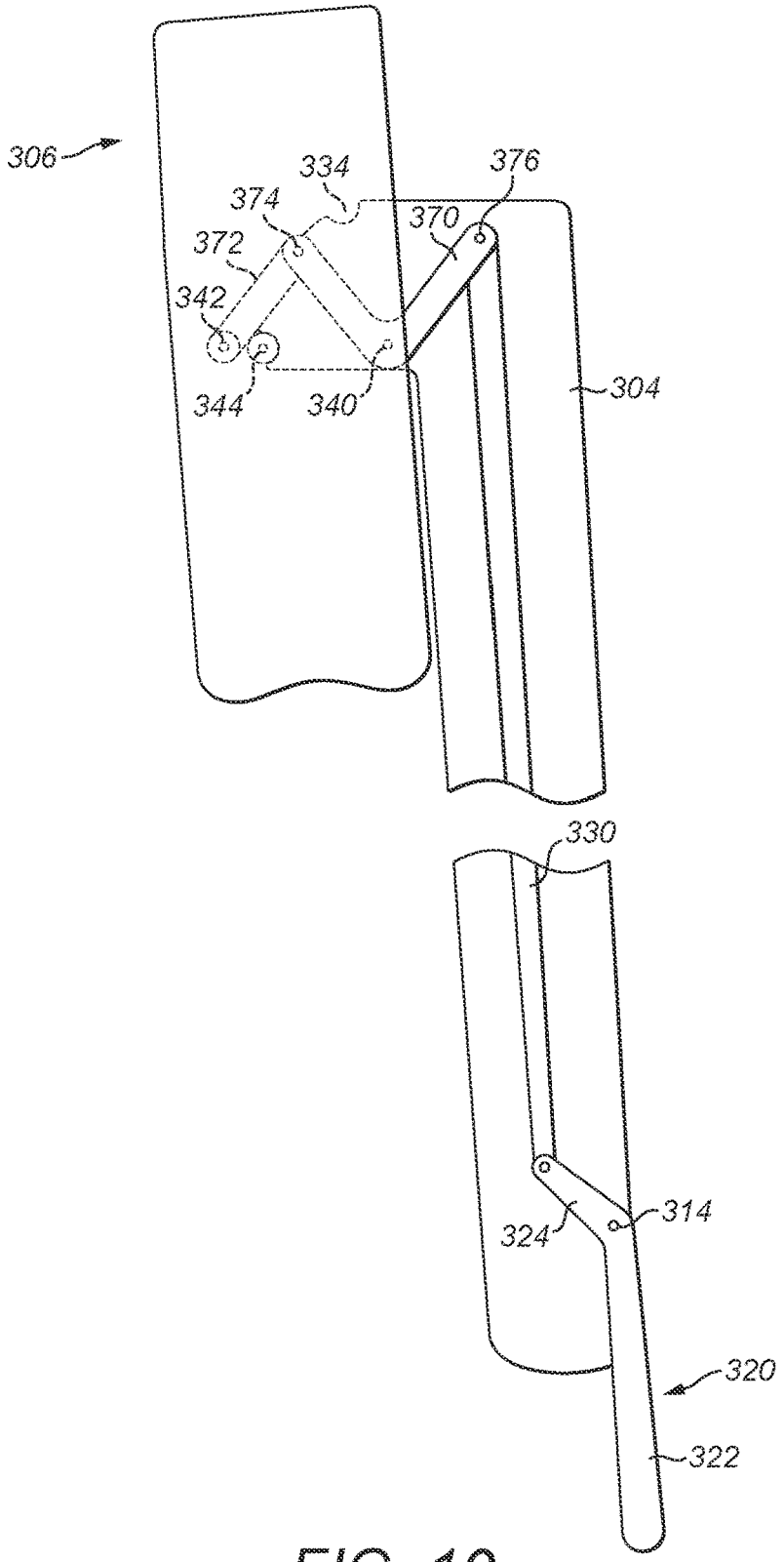
FIG. 10 shows a schematic side view in part section of the multipurpose walking device of FIG. 9 with the elements in a second position.

A further embodiment of the invention is shown in FIGS. 9 and 10. The multipurpose walking device can be seen to include an elongate shaft 304 having a handle 306 at a first end. The handle 306 is mounted for rotation with respect to the shaft 304 around a pivot 340 in the direction of arrows A. An L-shaped lever 370 is mounted for rotation about its central region on the pivot 340.

The first, upper end of the elongate shaft 304 is provided with a mounting structure. The mounting structure may be formed integrally with the elongate shaft 304 or may itself be secured to the elongate shaft 304.

A shoehorn 320 is mounted to a lower region of the shaft 304. The shoehorn 320 is generally L-shaped having a longer limb 322 and a shorter limb 324. The longer limb 232 is shaped at its free end to fit an item of footwear, such as a shoe, slipper or training shoe and enable a user to slide a foot into the item of footwear. The shorter limb 324 extends through an opening in the shaft 304. A free end of the shorter limb 324 is connected to a pin 326 in turn connected to a first end of a connecting rod 330, while another end of the shorter limb 324 is provided with parallel openings. In practice a pivot pin 314 extends through these openings and corresponding openings (not shown) in the shaft 304 to mount the shoehorn 320 to the shaft 304.

The connecting rod 330 extends through a passage (not shown) in the shaft 304 toward the mounting structure. A second end of the connecting rod 330 is mounted to a first end of the L-shaped lever 370 by a pivot pin 376.

The mounting structure at the upper end of the shaft conveniently comprises at least one cammed surface (similar to the embodiments of FIGS. 1 to 3). The at least one cammed surface is provided with first and second recesses 334,336.

The handle 306 conveniently comprises a hollow member including a longitudinal recess or channel. In FIG. 9, it can be seen that the handle 306 covers upper end of the shaft 304. A second pin 342 extends through the handle 306 approximately half way along the handle and in an upper region thereof. The second pin 342 is connected to a second end of a connecting pin 372. A first end of the connecting pin 372 is connected by a pivot 374 to a second end of the L-shaped lever 370.

The handle 306 is further provided to at least one side with an opening for a locating pin 344. The locating pin 344 may operate in any suitable manner and may for example be spring biased to a seated position.

When the handle 306 is in a first securable position, the locating pin 344 is operable releasably to seat in the first aligned recesses 334.

In the secured position shown in FIG. 9, the connecting rod 330 acts to keep the shoehorn 320 in position with respect to the elongate shaft 304.

To deploy the shoehorn 320, the locating pin 344 is first released from the first aligned recesses 334. The handle 306 may then be rotated with respect to the elongate shaft 304 (see arrow A in FIG. 1). The second pin 342 is drawn over the at least one camming surface in turn causing the L-shaped lever 370 to rotate about the pivot pin 340, drawing the connecting rod 330 upward such that the shorter limb 324 of the shoehorn is also drawn upwards to pivot the shoehorn 320 about pivot pin 314 until the shoehorn 320 is in the deployed position shown in FIG. 10. The locating pin 344 is then adjusted to seat in the second recess 336 to secure the handle 306 (and so the shoehorn 320) in position.

Once the user has put their footwear on, the shoehorn 320 is returned to the stored position and the handle 306 to the first position by reversing the above steps. In other words the locating pin 344 is unseated from the second recess 336 allowing the handle 308 to pivot and the shoehorn 320 to be driven around the pivot pin 314 by the connecting rod 330 until the locating pin 344 may once again be seated in the first recess 334.

The invention claimed is:

1. A multipurpose walking device comprising a shaft and a handle, the handle being disposed on an end of the shaft and being movable in relation to the shaft between a first securable position and a second securable position, in which movement of the handle between the first securable position and the second securable position causes a shoehorn to move from a first retained position to a second deployed position, wherein the handle and a structure attaching the handle to the shaft comprise the endmost structure on the end of the shaft when the shoehorn is in the first retained position, the handle further comprising a hollow interior portion, wherein the structure attaching the handle to the shaft is at least partially located within and shielded by the hollow interior portion of the handle when the shoehorn is in its first retained position, and further wherein the shoehorn is also partly located within and shielded by the hollow interior portion of the handle when the shoehorn is in its first retained position.

2. A multipurpose walking device according to claim 1, wherein the structure attaching the handle to the shaft comprises a connecting rod and a pivot pin.

3. A multipurpose walking device according to claim 1, wherein the handle is rotated with respect to the shaft.

4. A multipurpose walking device according to claim 1, in which the handle is secured in the first securable position by a displaceable member.

5. A multipurpose walking device according to claim 4, in which the handle is secured in each of the first securable position and the second securable position by the same displaceable member.

* * * * *